US007429919B2

(12) United States Patent
Silic et al.

(10) Patent No.: US 7,429,919 B2
(45) Date of Patent: Sep. 30, 2008

(54) MULTI-PURPOSE WIRELESS COMMUNICATION DEVICE

(75) Inventors: Bojan Silic, San Jose, CA (US); Timm Peddie, Palo Alto, CA (US)

(73) Assignee: Silicon Constellations, Inc., Santa Clara, CA (US)

( * ) Notice: Subject to any disclaimer, the term of this patent is extended or adjusted under 35 U.S.C. 154(b) by 500 days.

(21) Appl. No.: 10/942,580

(22) Filed: Sep. 16, 2004
(Under 37 CFR 1.47)

(65) Prior Publication Data

US 2005/0104747 A1 May 19, 2005

Related U.S. Application Data

(60) Provisional application No. 60/504,016, filed on Sep. 18, 2003.

(51) Int. Cl.
*G08G 1/095* (2006.01)

(52) U.S. Cl. ..... 340/539.1

(58) Field of Classification Search ..... 340/907, 340/944, 905, 916, 919, 925, 539.1, 555, 340/825.2, 825.69, 815.4, 384.1, 309.16
See application file for complete search history.

(56) References Cited

U.S. PATENT DOCUMENTS

| | | | | |
|---|---|---|---|---|
| 5,734,339 | A * | 3/1998 | Ogle | 340/944 |
| 6,384,742 | B1 * | 5/2002 | Harrison | 340/944 |
| 6,597,293 | B1 * | 7/2003 | Harrison | 340/944 |
| 6,683,540 | B1 * | 1/2004 | Harrison | 340/944 |
| 2002/0159834 | A1 * | 10/2002 | Hamakawa et al. | 404/14 |
| 2004/0075583 | A1 * | 4/2004 | Chaffe | 340/944 |

FOREIGN PATENT DOCUMENTS

| | | |
|---|---|---|
| EP | 05/78413 | 12/1994 |
| WO | WO 01/31125 A1 | 5/2001 |
| WO | WO 01/76909 | 10/2001 |
| WO | WO 02/36887 | 5/2002 |
| WO | WO 03/027397 | 4/2003 |

OTHER PUBLICATIONS

Written Opinion of the International Searching Authority, Jan. 2004.

* cited by examiner

*Primary Examiner*—Phung Nguyen
(74) *Attorney, Agent, or Firm*—North Weber & Baugh LLP

(57) ABSTRACT

A system, apparatus and methods are described that wirelessly communicate with its environment in response to stimuli generated locally within a communication device or within a remote activation device.

27 Claims, 10 Drawing Sheets

Illuminated Crosswalk

Side View of a Wireless
Multi-Purpose Communication Device

400

Top View of a Wireless Multi-Purpose Communication Device

Wireless Multi-Purpose Communication Device

Wireless Activation Device

Configuration Device

MULTI-PURPOSE WIRELESS COMMUNICATION DEVICE

CROSS REFERENCE TO RELATED PATENT APPLICATIONS

This application claims priority to U.S. Provisional Application No. 60/504,016, filed Sep. 18, 2003, which application is incorporated herein by reference in its entirety.

BACKGROUND

1. Technical Field

The present invention relates generally to wireless communication technology, and more particularly, to a wireless communication device that may be mounted on a surface, such as a road, and communicate instructions, delineate a path/lane, record events, and/or respond to stimuli from the environment in which it operates.

2. Background of the Invention

The importance of clearly delineating roads, crosswalks, sidewalks, and other transportation ways is well known. Surface markings, such as painted lane markers on roadways or painted crosswalks, have been historically used to define transportation ways on a road. Oftentimes, crosswalks may be painted a different color than lane markers in an attempt to highlight the crosswalk on the road.

FIG. 1 illustrates an example of a typical crosswalk across a street. As shown, pedestrians are provided a crosswalk 130 on which they may cross a street 110. In this particular example, the street 110 has traffic moving in two directions. Traffic lanes are delineated by lane markers 145 that are typically painted directly onto the street 110. Also, the crosswalk 130 may be identified on the street 110 by paint that is a different color than the lane markers 145.

The purpose of the crosswalk 130 is to identify to a pedestrian and an automobile driver where the pedestrian should cross the street 110. Inherent in this purpose is that an automobile driver is aware that he or she is approaching a crosswalk so that extra caution may be used to avoid injuring a pedestrian.

The ability of a driver to view the painted crosswalk markings may become hindered depending on the environment. Oftentimes, a painted crosswalk is difficult for an automobile driver to notice because of darkness, fog, rain or other events that may limit the visibility of the crosswalk.

A few cities have installed reflectors or reflective tape along a crosswalk to enhance the visibility of the crosswalk. An even smaller number of cities have installed wired lights along a crosswalk to further enhance the visibility of the crosswalk. The installation of these wired lights requires trenching and the laying of a physical conduit, resulting in significant destruction of the road, in order to provide power to each of the lights. These wires provide each light sufficient power to operate. After the wire has been laid and the lights installed, the road strip must be re-paved so that automobiles can once again drive across it. This installation usually requires that traffic be diverted and may take a significant amount of time to complete the installation process. Furthermore, maintenance of these wired lights may become troublesome as wiring may erode and replacement may require additional trenching and/or removal of a significant portion of the street.

SUMMARY OF THE INVENTION

A wireless communication system is described including a multi-purpose wireless communication device, an activation device and a configuration device. The wireless communication device can be attached to a surface, such as a road, and may communicate information to its environment and record data from its environment. The wireless communication devices may have (1) an antenna or wireless transceiver that allows wireless communication, (2) digital logic, and (3) a mechanism(s) to provide information to its environment and individuals. This communication mechanism(s) may include light emitters, audio components, and graphics displays. The digital logic may provide processing for data received from sensors or external communication channels.

The activation device may include a wireless transceiver or antenna, and digital logic. The wireless transceiver or antenna communicates with the wireless communication device, which may include an activation command that triggers the wireless communication device. The activation device may also communicate with other activation devices to extend the reach of communication. The configuration device includes a processor, and an interface to configure the wireless communication device or activation device. This interface may be a wireless transceiver or a wire interface (such as an RS232 serial interface) through which configuration data may travel.

The present invention has many different embodiments and may be applied to numerous different environments. Variations upon and modifications to these embodiments are provided for by the present invention, which is limited only by the claims.

BRIEF DESCRIPTION OF THE DRAWINGS

Reference will be made to embodiments of the invention, examples of which may be illustrated in the accompanying figures. These figures are intended to be illustrative, not limiting. Although the invention is generally described in the context of these embodiments, it should be understood that it is not intended to limit the scope of the invention to these particular embodiments.

DETAILED DESCRIPTION OF THE PREFERRED EMBODIMENTS

A system, apparatus and method is described for wireless communication from a surface mounted device to another device or individual. Several embodiments of the present invention are described that relate to the identification and/or highlight of crosswalks to both pedestrians and automobile drivers. Other embodiments of the present invention are also described that relate to location notification of an object, dynamic road lighting, notification of speed to an automobile driver, hazard identification, emergency vehicle turnout notification and traffic warning, roadway exit identification, airport traffic flow, children/elderly/handicapped presence notification, vehicle exit/approach warning, security identification, national emergency notification, festive lighting, instructional aid, advertisement, corridor traffic counter, temperature identification, motion detection and seismic sensor and recorder. These described embodiments are exemplary and one skilled in the art will recognize variations to and modification of these embodiments are included within the present invention.

In the following description, for purposes of explanation, specific details are set forth in order to provide an understanding of the invention. It will be apparent, however, to one skilled in the art that the invention can be practiced without these details. Furthermore, one skilled in the art will recognize that embodiments of the present invention, described below, may be incorporated in a number of different environments. Accordingly, structures and devices shown below in block diagram are illustrative of specific embodiments of the invention and are meant to avoid obscuring the invention.

Reference in the specification to "one embodiment", "another embodiment" or "an embodiment" means that a particular feature, structure, characteristic, or function described in connection with the embodiment is included in at least one embodiment of the invention. The appearances of the phrase "in one embodiment" in various places in the specification are not necessarily all referring to the same embodiment.

A. SYSTEM OVERVIEW

Figure 1:
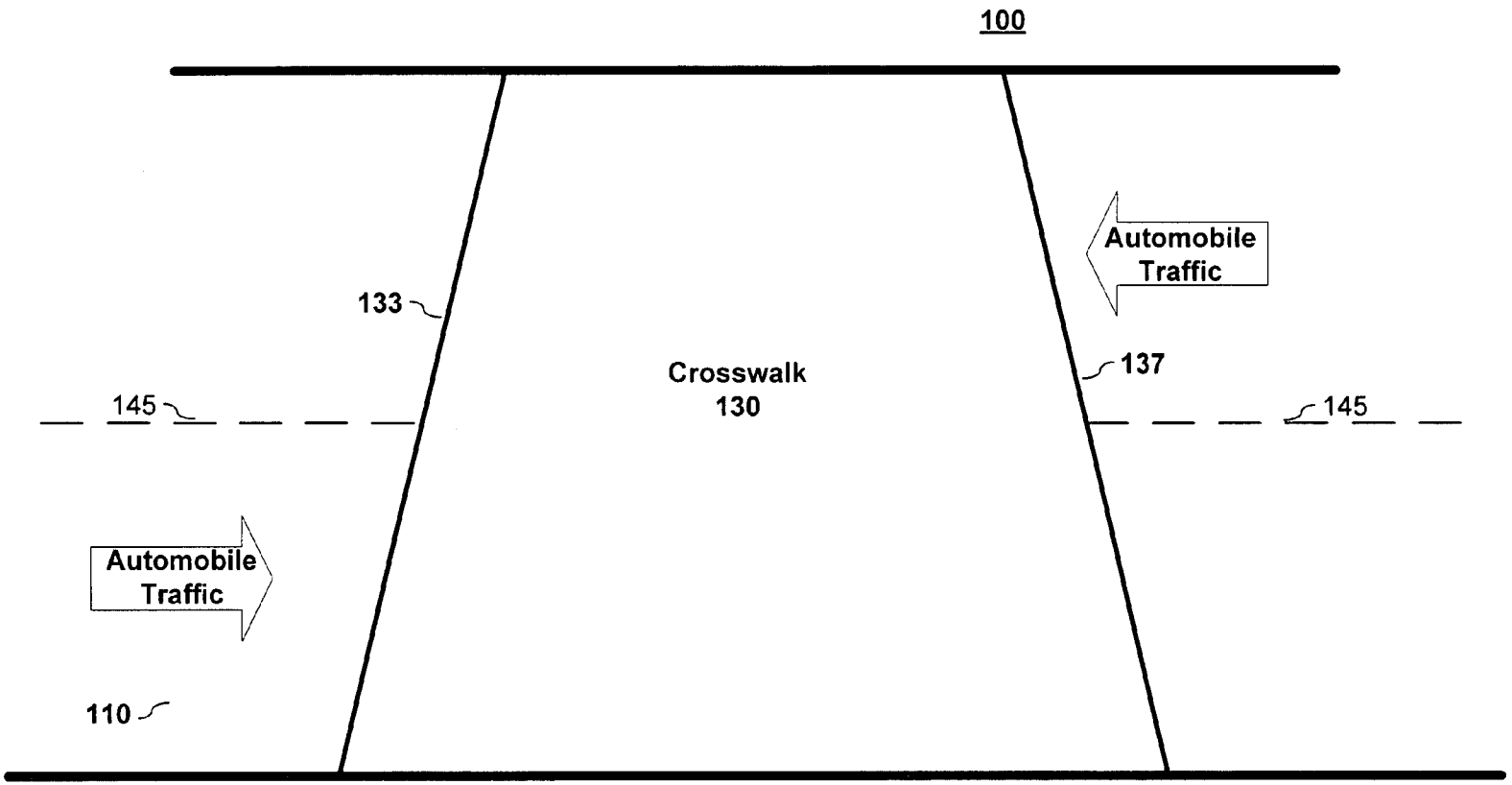
FIG. 1 is an illustration of a traditional crosswalk that is delineated across using paint or other non-illuminating mechanism.
Figure 2:
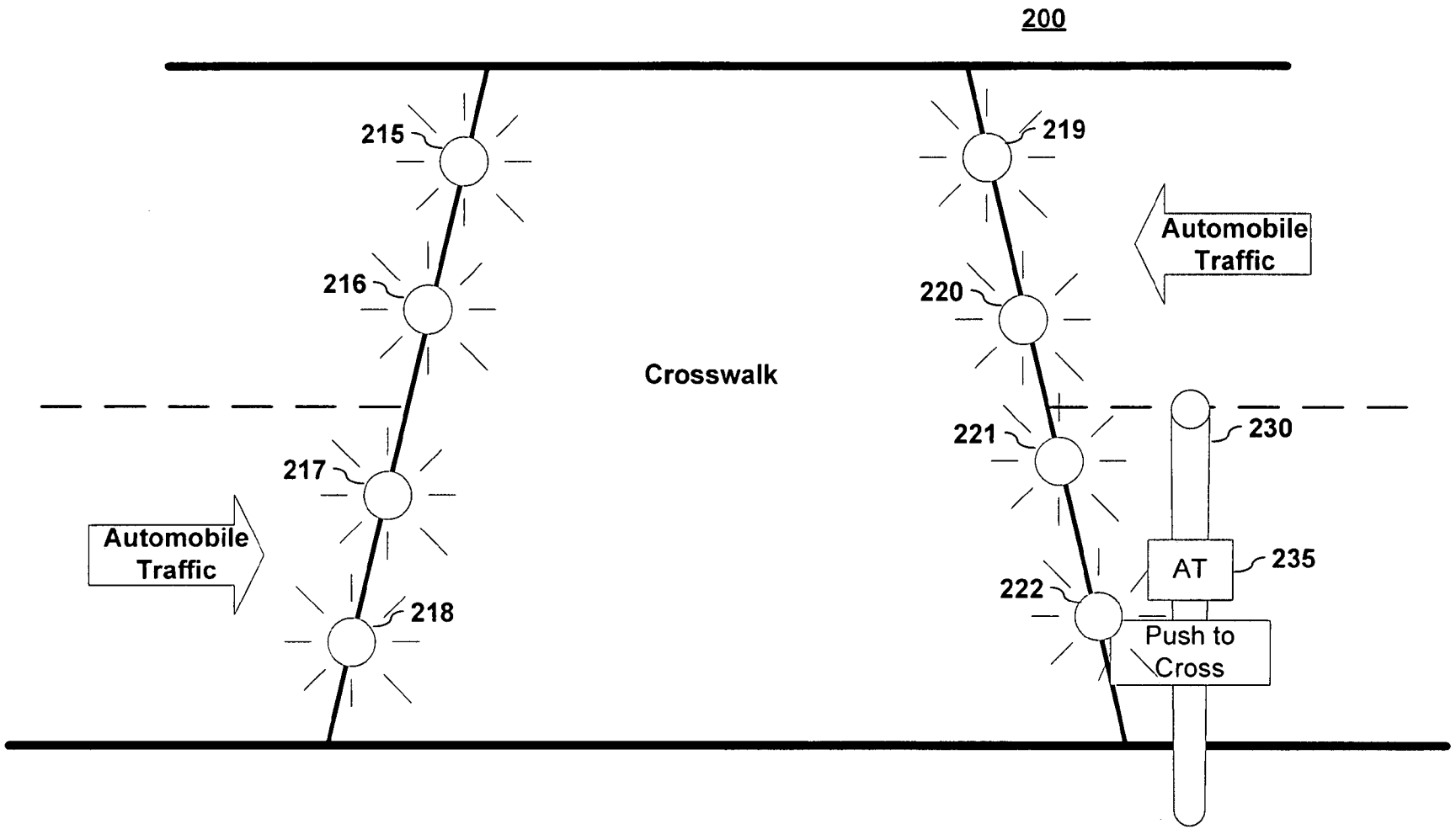
FIG. 2 is an illustration of an embodiment of the invention wherein a system that dynamically illuminates and/or communicates a crosswalk is shown.

FIG. 2 illustrates an embodiment of the present invention where an intelligent wireless communication system identifies a crosswalk 210 to pedestrians and automobile drivers. This wireless communication system 200 includes multiple wireless communication devices 215-222 and an activation transceiver 235. The wireless communication devices 215-222 are installed along the crosswalk 210 and positioned so that a communication component, such as a light emitting diode(s), may be seen by automobile drivers and pedestrians. The communication devices 215-222 have unique power and signaling characteristics that allow for wireless communication, thereby avoiding trenching or laying a physical conduit for wire under the road during installation and/or maintenance. The activation transceiver 235 is positioned so that a pedestrian can trigger the transceiver 235 to turn on the communication devices 215-222.

In this embodiment of the invention, a pole 230, located on a sidewalk near the crosswalk 210, contains a button that triggers the activation transceiver. A pedestrian can push the button, after which the activation transceiver 235 sends an electromagnetic signal (e.g., an activation command) that initiates the multiple wireless communication devices 215-222. The communication devices 215-222 may respond to the activation transceiver's electromagnetic signal in a number of different ways to communicate that a pedestrian will be entering the crosswalk 210. This communication may include the emission of light or an audio output. The communication devices 215-222 may also communicate with the pedestrian by providing information regarding how long the pedestrian should remain in the crosswalk or provide audio guidance to a handicapped individual.

In one embodiment of the invention, the communication devices 215-222 begin to illuminate after the activation transceiver's activation command is received. The communication devices 215-222 may flash to further highlight that a pedestrian is entering the crosswalk 210. The communication devices 215-222 may also flash at various frequencies to communicate information to the pedestrian or automobile driver. For example, the communication devices 215-222 may flash at a faster rate to indicate that a short amount of time remains for a pedestrian to cross the street. The communication devices 215-222 may be configured to ensure that the blinking is synchronized between the devices 215-222. A traffic engineer or city planner may configure the communication devices 215-222 to flash and/or provide an audio message by using a configuration tool for the devices 215-222.

In yet another embodiment of the invention, the communication devices 215-222 may have sensory components that determine when a particular event occurs, such as nighttime, and activate the communication devices 215-222. Other examples of sensors may include motion sensors, time-of-day sensors, magnetic sensors (such as Hall Effect devices), RF sensors (such as microwave sensors) and optical sensors (such as infrared, visible light or other optical sensors).

In addition to audio and light emissions, the communication devices 215-222 may also have other types of outputs. For example, the communication devices 215-222 may have RF or wireless spectrum output using data linking to one or more recording or interactive devices such as base stations, transceivers, processing units or network accessible devices. Furthermore, the communication devices 215-222 may output an infrared spectrum and a wired or baseline communication.

One skilled in the art will recognize that the invention has a large number of different embodiments and applications, some of which are described in more detail below, beyond the above-described particular crosswalk embodiment.

B. MULTI-PURPOSE WIRELESS COMMUNICATION DEVICE

Figure 3:
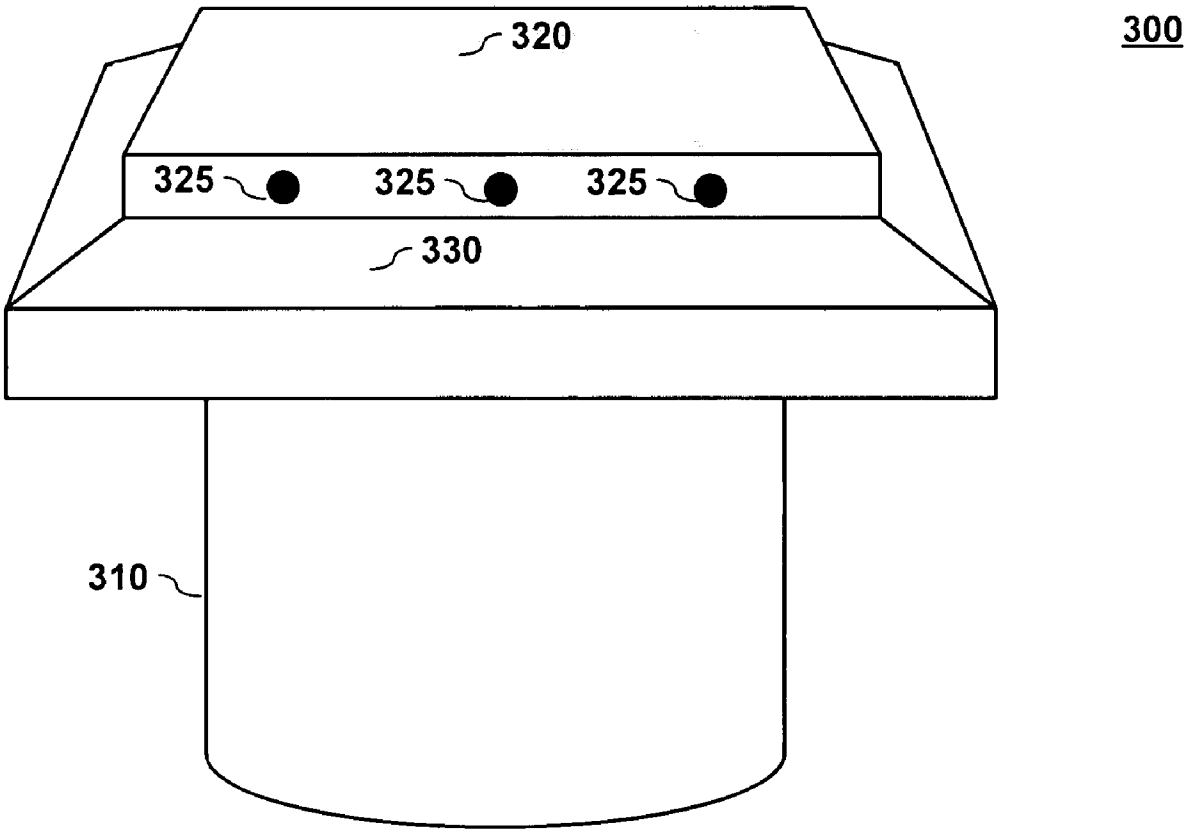
FIG. 3 is a side view illustration of an embodiment of a wireless multi-purpose communication device.
Figure 4:
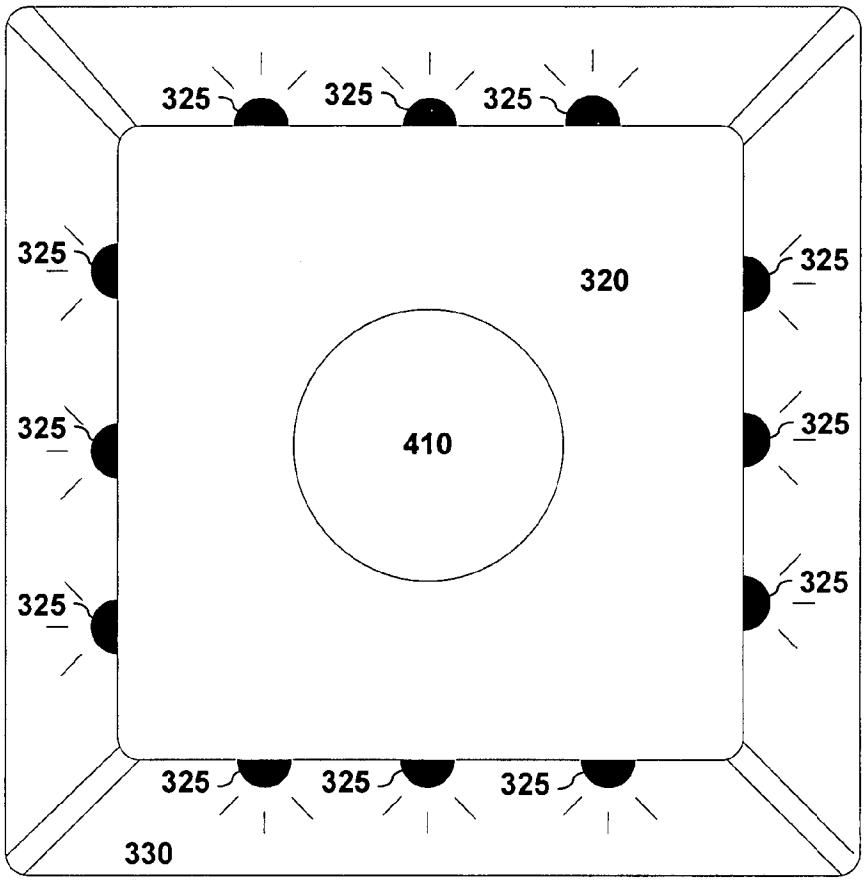
FIG. 4 is a top view illustration of an embodiment of a wireless multi-purpose communication device.
Figure 5:
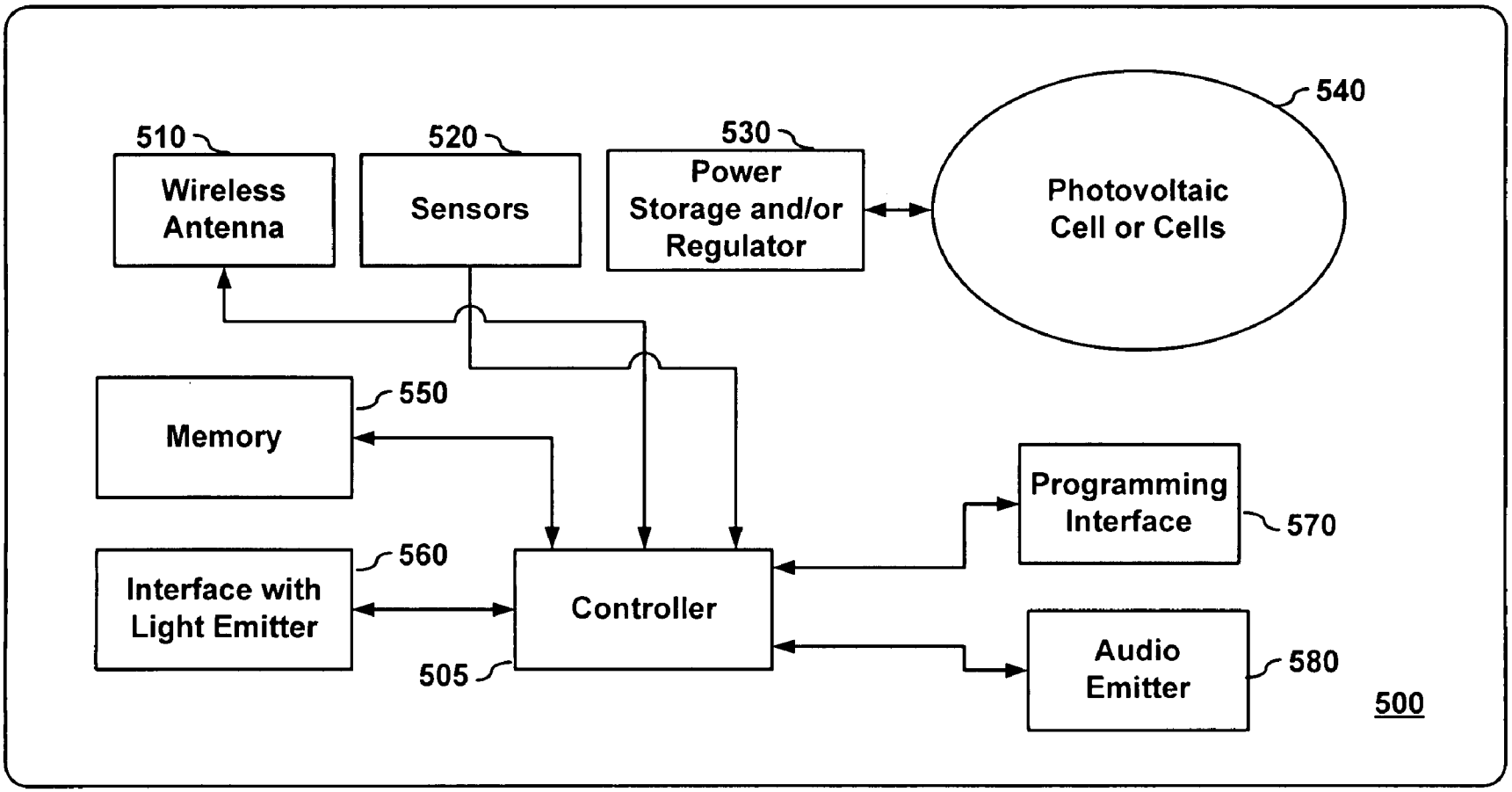
FIG. 5 is a block diagram of a wireless multi-purpose communication device according to one embodiment of the invention.

FIGS. 3-5 illustrate one or more embodiments of the multi-purpose wireless communication device. FIGS. 3 and 4 represent a physical structure of the one or more embodiments, and FIG. 5 represents an electrical structure of the one or more embodiments. The electrical connections shown in FIG. 5 do not necessarily mean that the connections between the various components are directly connected; rather, that data may be communicated either directly or indirectly between the components.

1.Physical Structure

FIG. 3 is a side view illustration of an embodiment of a multi-purpose wireless communication device according to the present invention. As shown, a multi-purpose wireless communication device 300 has a stem 310, a base surface structure 330, a light emitting surface containing multiple light sources 325, and top surface structure 320.

According to one embodiment of the invention, the stem 310 adheres the communication device 300 to a surface, such as a road, on which it will operate. In this particular example, the stem 310 is inserted into a hole within the surface, such as a road, and an adhesive substance such as strong glue or epoxy is injected into the hole. After the glue or epoxy has dried to the stem 310 and the surface, the communication device 300 is sufficiently fixed to the surface so automobiles or other heavy objects may pass over the device 300 without loosening it from the surface. Thus, if the communication device 300 is fixed at an edge of a crosswalk, the road does not need to be trenched and wire conduit does not need to be laid; rather, small holes need to be drilled within the road so that the communication device 300 may be inserted into them.

The base structure 320 may rest on top of a surface and supports various internal components within the communication device 300. In this embodiment, the base structure 320 is coupled to the stem 310 and may also be used to further adhere the communication device 300 to the surface. The base structure 320 may also be slanted to make a less bumpy surface for an automobile to drive over.

According to one embodiment of the invention, the communication device 300 includes an array of light emitters 325 that are positioned above the surface. In one example, the light emitters 325 may be light emitting diodes ("LEDs"). In another example, the light emitters may include quartz halogen lights. The light may also be a single color or many different colors. The light emitters may be controlled by electronics within the communication device 300, which many define a number of different emission characteristics including different flash frequency rates, light emission durations, operating modes and power consumption.

The top surface 320 encloses various electrical components within the communication device 300. This top surface 320 may be sufficiently strong to support heavy objects such as automobiles so that the communication device 300 is not damaged when a car drives over it. The top surface 320 may be clear to allow sunlight to charge a solar panel for a photovoltaic component within the communication device 300. The top surface 320 may also include an antenna or transceiver that is used to receive or transmit signals from an activation transceiver or other communication device. The top surface 320 may also include an audio mechanism such as a speaker to transmit audio waves or a microphone to record audio waves. The top surface 320 may also include other components that would enable the communication device 300 to communicate or receive information from its environment.

FIG. 4 is a top view illustration of one embodiment of a multi-purpose wireless communication device according to the invention. As shown, a multi-purpose wireless communication device 400 has a top surface structure 320 having a clear or semi-clear structural support mechanism 410 under which a solar panel may reside, a plurality of light sources 325, a base surface structure 330, a light emitting surface containing multiple light sources 325, and top surface structure 320.

According to one embodiment of the invention, the top surface structure 320 is strong enough to support heavy objects. This top surface structure 320 may contain a clear surface through which sunlight may pass so that a solar panel within the wireless communication device 400 can charge. If appropriate, the top surface structure 320 may contain a solar panel, wireless transceiver/antenna or other component. The top surface structure 320 may also protect electronics, such as an integrated circuit board, a speaker, and a wireless transceiver or antenna, that are housed underneath the top surface structure 320 from the environment.

In one embodiment of the invention, the light sources 325 may extend beyond the edge of the top surface structure. This design would allow more visibility to a pedestrian positioned above the wireless communication device 400. It is important to note that the top surface structure may also contain a messaging mechanism, such as light emitting diodes to allow communication. For example, illuminated arrows, words or pictures may appear on the top surface structure 320 to communicate various messages. Furthermore, these messages may be displayed on any other surface of the wireless communication device 400 including the base surface structure.

The above-described embodiments are examples of the present invention. One skilled in the art will recognize that the present invention may embody a number of different physical structures.

C. ELECTRONICS

Figure 6:
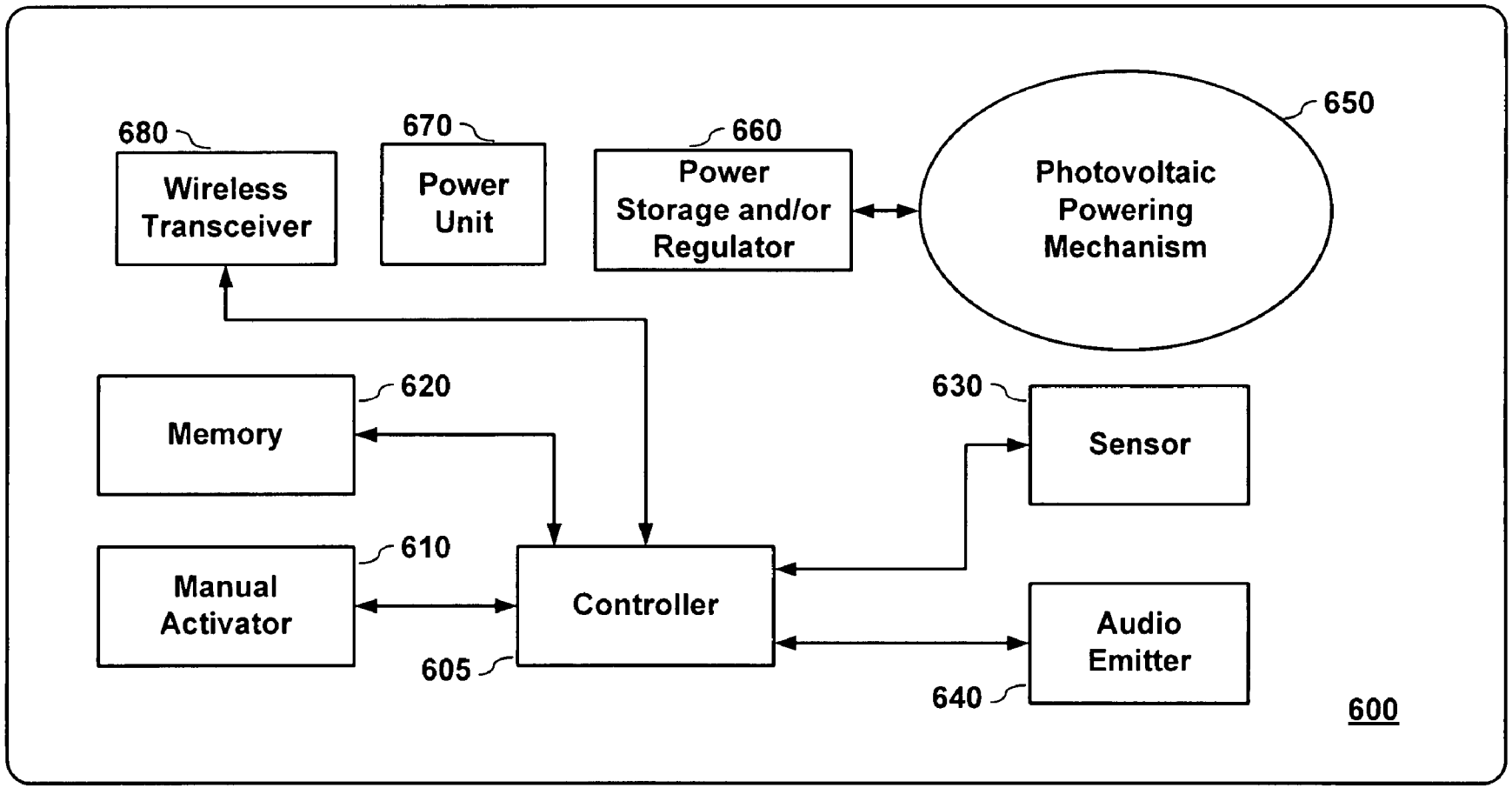
FIG. 6 is a block diagram of a wireless activation device according to one embodiment of the invention.
Figure 7:
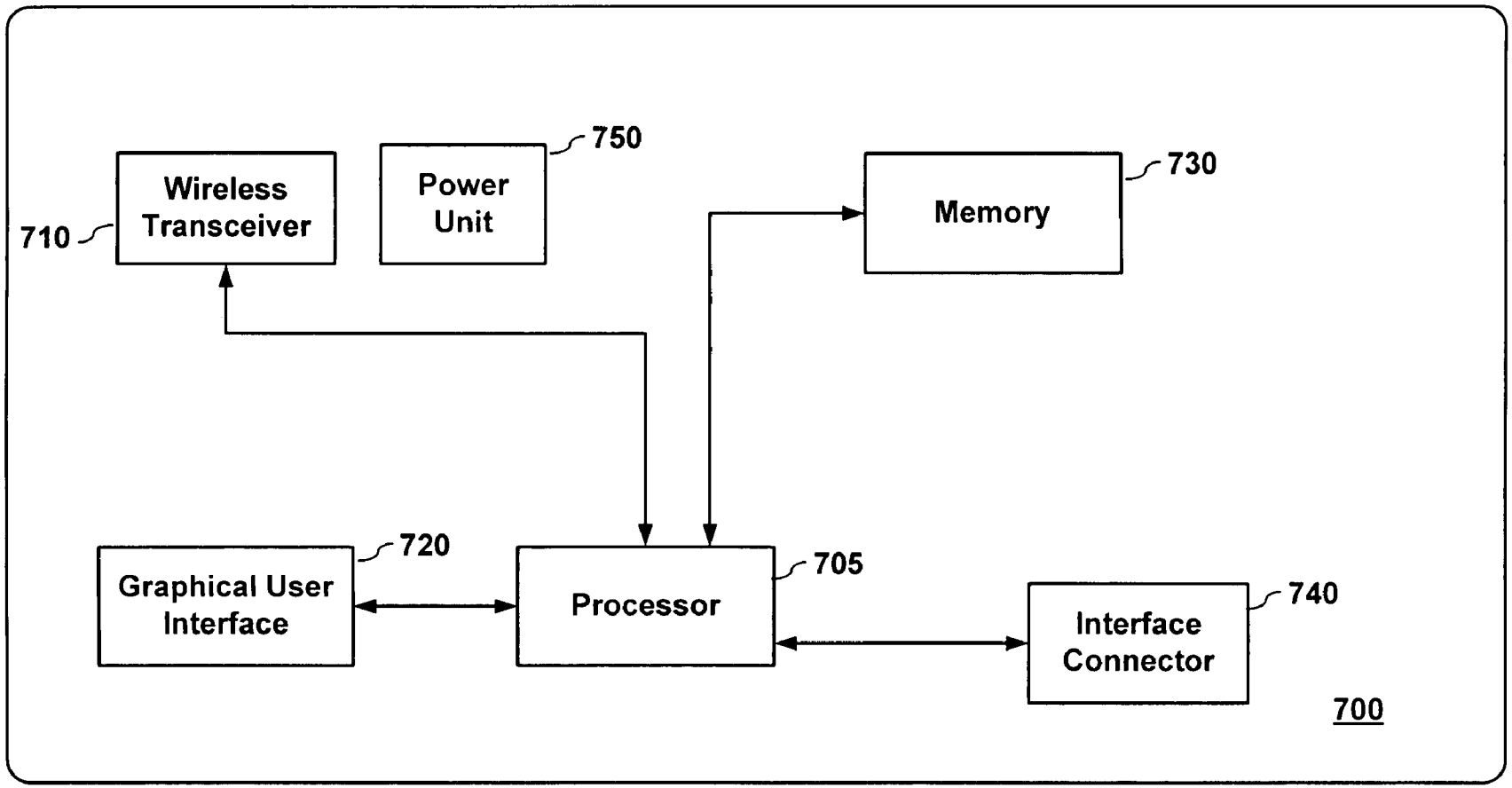
FIG. 7 is a block diagram of a configuration device according to one embodiment of the invention.

FIGS. 5-7 are block diagrams illustrating various embodiments of the present invention. The illustrations represent components as blocks and data paths as lines. These lines are not intended to suggest direct connections between components; rather illustrate that data or power may travel between the two connected components. Furthermore, this data may be re-formatted, modified, processed or otherwise manipulated by various objects between particular components.

a) Multi-purpose Wireless Communication Device

FIG. 5 illustrates one embodiment of a multi-purpose wireless communication device 500 according to the present invention. This embodiment of the wireless communication device 500 may include a wireless antenna 510, at least one sensor 520, a power storage and/or regulator 530, a photovoltaic powering mechanism 540, memory 550, an interface with at least one light emitter 560, a controller 505, a programming interface 570 and an audio emitter 580.

The controller 505 is used to control and/or monitor various components in the wireless communication device 500. In one embodiment, the controller 505 is a digital logic component, such as an application processor or digital controller, which is able to communicate with a number of different components. The controller 505 may communicate and control light emitters, such as light emitting diodes, via the light emitter interface 560, by turning the light emitters on and off. Additionally, the controller 505 may control the frequency at which lights blink and the duration of time during which the lights are activated. The controller 505 may also dynamically control lights to create words, symbols or pictures on the wireless communication device 500. The brightness of the lights may also be controlled based on the output of the power storage device 530, the photovoltaic cell 540, or the battery charge level. This control of light intensity increases the life of a rechargeable battery while also protecting against overcharge or meltdown.

One method, according to an embodiment of the invention, for controlling light intensity includes the controller 505 monitoring a battery energy level and responding by selecting light intensity levels. The controller 505 may sample the power storage voltage over a period of time and integrate its value, from which a power storage voltage level can be extracted. The controller 505 may increase the light intensity as the power storage voltage level is approached or decrease the light intensity as the power storage voltage decreases. This modification of current helps to prevent overcharging or complete discharge of the power storage device 530.

The controller 505 may also control the wireless antenna 510 and/or the audio emitter 580. The wireless antenna 510 may use a variety of signaling methods including, but not limited to, ASK, PSK, QPSK, FSK, GMSK, frequency hopping spread spectrum, direct sequence spread spectrum at data rates consistent with the band of operation. This band of operation may be any licensed or unlicensed allocated spectrum. The audio emitter 580 may be used to transmit various audible sounds including spoken language and warning sounds. The volume and messaging from the audio emitter 580 may be dynamically adjusted by the wireless communication device or by an individual such as a city engineer.

The controller 505 may also receive information from a single or multiple sensors 520 on the wireless communication device 500. These sensors may be various types including RF or wireless, optical including infra-red, acoustical, mechanical, and magnetic for the detection of external phenomena. In response to information received from the sensors 520, the controller 510 may respond by performing a specific function, such as activating light emitters, transmitting an audio signal, or otherwise provide communication to the outside environment.

The wireless communication device 500 may have software stored in a memory unit 550. This software may be used to boot-up the wireless communication device 500, define operating parameters for the wireless communication device 500 and store data collected by the device 500. Furthermore, this software may be updated through a programming interface 570 or via data received on its wireless antenna 510 or transceiver. The programming interface 570 may be a number of different interfaces including an RS232 serial interface, USB, Firewire, Ethernet, Infra-red, or any other type of interface that would allow an individual to update the wireless communication device 500. This interface 570 allows and individual to update or modify operational characteristics of the communication device 500 or retrieve data that has been stored within the memory 550.

According to this embodiment of the invention, the wireless communication device 500 includes a solar power mechanism. In this particular example, the power mechanism absorbs solar energy from one more self-powering mechanisms such as a photovoltaic cell(s) 540. The photovoltaic cell(s) 540 may be used in conjunction with a power storage device and/or regulator 530, such as a rechargeable battery. For locations of little or no solar exposure, a specialized long lasting energy storage device such as a non-rechargeable battery may be used. In one embodiment of the present invention, a one-way energy valve diode may be used that controls battery leakage to the solar cell during times when there is little or no solar exposure. The energy valve diode may also manage the power cross-over between both the rechargeable and non-rechargeable batteries. Furthermore, the energy valve diode may be configured with one or more sensor tiers that monitor the flow of energy between a self-powering mechanism and a rechargeable battery.

A switching mechanism between a rechargeable battery and the photovoltaic cell(s) 540 may be used to control which power mechanism is used. This switching mechanism may be implemented by a number of different components including diodes and MOSFETs. In addition, one embodiment of the present invention may include a directional sensor which may reduce the effective loss in the above-described energy valve diode.

Generally, the wireless antenna 510 and associated electronics (receiver) require a relatively large amount of power to operate properly. In one embodiment of the present invention, a threshold control or multiple threshold controls monitor the recharging of a rechargeable battery. For example, multiple voltage comparators may be set to detect different thresholds. These comparators output logic levels that are provided to the controller 505 for analysis. Based on the analysis of these output logic levels, the controller 505 may determine an appropriate operating mode for the communication device 500.

The wireless communication device 500 may operate in a number of different modes including a stand-by mode, an active mode, a service mode, and a sleep mode. In stand-by mode, the controller 505 is operating in a low power mode and a radio integrated circuit on the receiver cycles between active and shutdown states. This cycling allows the communication device 500 to conserve power while waiting for operation commands.

An active mode may be initiated in the communication device 500 upon reception of a wakeup command. In active mode, the radio integrated circuit may continuously scan for command packets. This active mode requires more power than the stand-by mode described above.

A service mode may be initiated by an external source or automatically engage upon sensing of marginally low power storage voltage. The purpose of this mode is to prevent further discharge of the power storage device 530 due to continued operation of sensory outputs such as light emitters or an audio emitter 580. In addition, the wireless communication device 500, operating in service mode, may not respond to operation commands but only service commands. If the service mode was initiated due to the crossing of a voltage threshold, the communication device 500 may return to a different mode once a normal power storage device threshold has been exceeded, or go into a sleep mode if the power storage device voltage falls below a critical low threshold.

A sleep mode may be initiated upon sensing a critical low power storage condition. The primary purpose of this sleep mode is to conserve power during long periods in which the power storage device 530 can not recharge. The wireless communication device 500 may send certain or all components into a shutdown mode to conserve power until the power storage voltage returns above the critical threshold level. There may be multiple tiers of sleep mode according to the application, environment and/or functionality of the wireless communication device 500.

In yet another embodiment, power consumption by the receiver may be lowered by having the wireless communication device 500 sample an input communication channel(s) on a periodic basis. Signals on the input communication channel may be timed so that one or more transmissions of the signal occur during the sampling window. The wireless communication device 500 may return to an inactive mode, stand-by mode, service mode, sleep mode or other mode between sampling instances. This method reduced the power consumption on the power storage device 530.

One skilled in the art will recognize that there are a large number of methods may be employed for conserving battery voltage that fall within the scope of the invention.

b) Wireless Activation Device

FIG. 6 illustrates one embodiment of a wireless activation device 600 according to the present invention. This embodiment of the wireless activation device 600 may include a wireless transceiver 680, at least one sensor 630, a power storage and/or regulator 660, a photovoltaic powering mechanism 650, memory 620, a manual activator 610, a controller 605, a power unit 670, and an audio emitter 640.

In one embodiment of the invention, the wireless activation device 600 connects with one or more wireless communication devices 500 and activates a single wireless communication device 500 or a plurality of wireless communication devices 500. Additionally, a wireless activation device 600 may function as a repeater to allow communication over longer distances. The wireless activation device 600 may be placed in close proximity to the wireless communication device 500, as described above with the crosswalk embodiment, or may be placed on a neighboring structure including a building, overhead wire, or traffic light.

The controller 605 controls the various functions of the wireless activation device and is a digital logic device such as a small microcontroller or an application processor. The wireless activation device 600 may contain a memory device 620 that allows software to be stored and accessed by the controller 605 or allows for data to be recorded.

In one embodiment of the present invention, the wireless activation device 600 may also include an optional photovoltaic cell(s) that can be used to power the device 600. Additionally, the photovoltaic cell(s) may charge a power storage device 660, such as a rechargeable battery. The wireless activation device 600 may include a power unit 670, which may be a non-rechargeable battery that acts as a primary or secondary power device.

In one embodiment of the present invention, the wireless activation device 600 may include an audio emitter 640 to communicate with individuals. For example, the audio emitter may make a sound to indicate that it is safe to walk across a crosswalk. In addition, the audio emitter 640 may provide an audible message.

c) Configuration Device

FIG. 7 illustrates one embodiment of a configuration device 700 according to the present invention. This embodiment of the configuration device 700 may include a wireless transceiver 710, a power unit 750, a memory device 730, a graphical user interface 720, a processor 705, and a connector interface 740.

The configuration device 700 may be used for programming of the wireless communication device 500. The configuration device 700 may also be used to retrieve data from the wireless communication device 500 and the activation device 600. The configuration device 700 may be integrated into a computing device, such as a laptop computer or a personal desktop assistant ("PDA"), or may be a stand-alone device. Additionally, one or more communication sequences may be administered through the configuration device 600 to allow sequential signaling between wireless communications device 500.

In one embodiment of the present invention, the configuration device 700 includes the processor 705 and the memory 730 in which software may be stored to perform particular functions on the wireless communication device 500. For example, the configuration device 700 may allow for dynamic customizations including changing the duty cycle, frequency, duration of a primary pattern, flash duration of concluding or additional patterns. These dynamic customizations, and other not listed but included in the present invention, allow a wireless communication device 500 to adapt to changing federal and state regulations.

The customization of the wireless communication device 500 by the configuration device 700 may be done through the interface connector 740. This interface connector 740 allows the configuration device 700 to communicate with the wireless communication device 500 both prior to and after installation. Furthermore, the interface connector 740 allows for monitoring, configuring and testing remotely, either through a wire connection or a wireless connection. For example, a city engineer may be able monitor and configure a wireless communication device 500 via the internet or private network. The interface connector 740 may be wireless, Ethernet, USB, Firewire, RS232 serial interface, infra-red or other type of communication interface.

In one embodiment of the invention, the configuration device 700 may also include a graphical user interface ("GUI") 720. The GUI 720 may offer a visual representation or simulation of desired control parameters that may be relevant to a traffic engineer, city planner or other system manager. This GUI 720 may gauge the effective and aesthetic parameters of any configuration prior to deploying or configuring the wireless communication device 500.

The configuration device 700 may also be configured to remotely control an individual sensor or sensors on the wireless communication device 500. This sensor management allows for lighting to be changed or modified without need of replacing a wireless communication device 500.

D. COMMUNICATION SIGNALING

Figure 8:
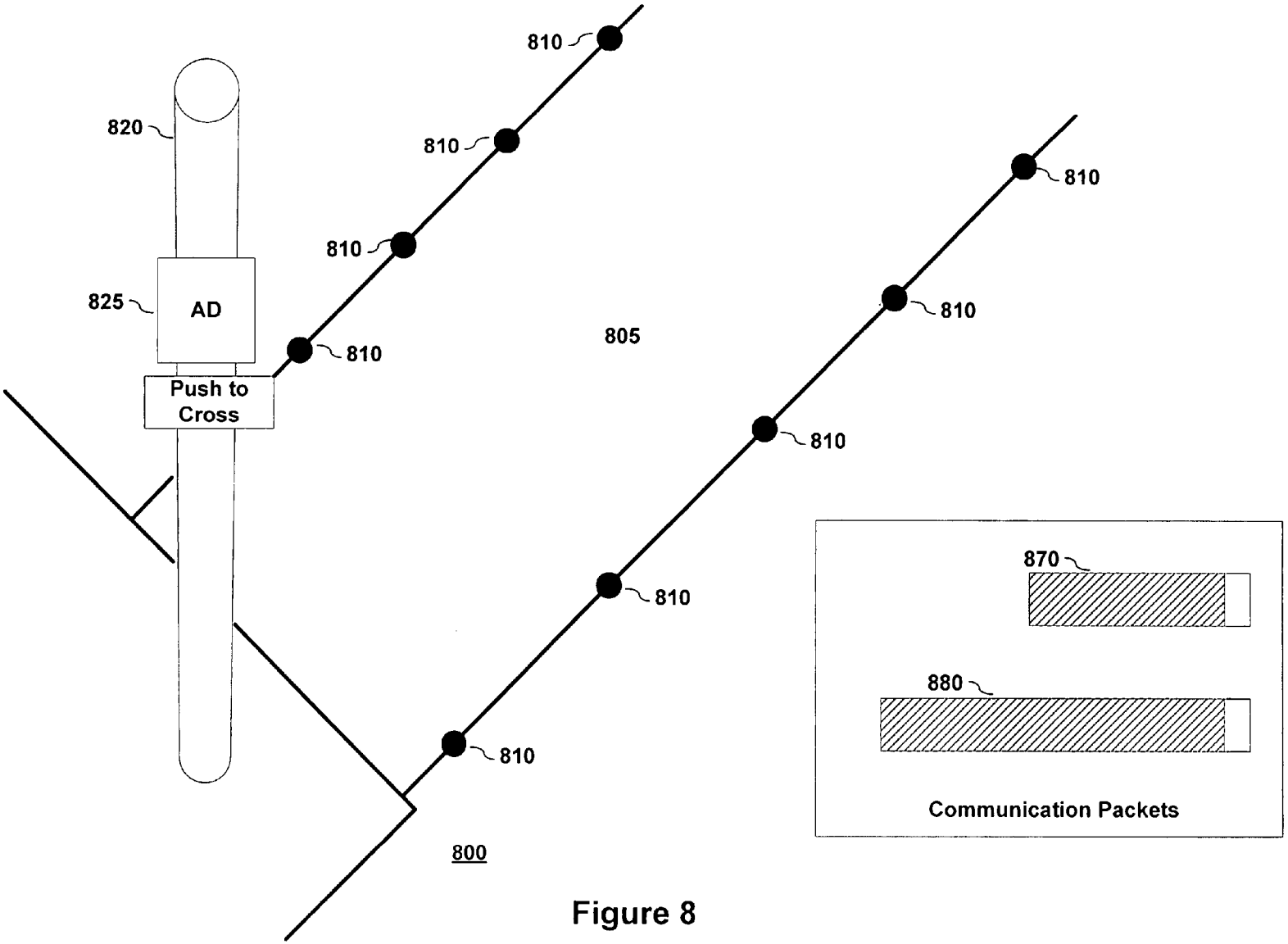
FIG. 8 is an illustration of wireless multi-purpose devices and a wireless activation device, and exemplar communication packets, according to one embodiment of the invention.

FIG. 8 is an embodiment of the invention, wherein multipurpose wireless communication devices 810, positioned along a crosswalk, are controlled by an activation device 825. The activation device 825 communicates with at least one of the wireless communication devices 810 via a communication channel.

In one embodiment of the invention, the communication channel uses variable packet lengths in order to minimize the channel traffic size. As shown in FIG. 8, a first packet 870, having a header and payload, may be smaller than a second packet 880. These packets may be organized as broadcast packets targeted for all wireless communication devices and/or activation devices within range, or may be individually addressed packets intended for a single wireless communication device 810 or activation device. The wireless communication devices 810 may individually updated for usage statistics, information for diagnostic analysis, environmental identification, and device specific communication.

In one embodiment of the invention, signaling between the activation device 825 and the wireless communication device 810 may occur over multiple channels. The use of multiple channels may use spread spectrum techniques to enhance channel reliability and packet detection. For example, the activation device 825 may utilize an "A" channel or channel sequence while another activation device (not shown) may utilize a "B" channel or channel sequence to communicate with wireless communication devices. Additionally, the activation device 825 may be configured to listen for a status command from other activation devices. Upon receiving this command, the activation device 825 switches to another channel, broadcasting to other wireless communication devices 810. This use of multiple activation devices increases potential distance limitations from FCC restrictions that limit power and signal strength.

In one embodiment of the invention, the wireless communication device may improve its consistency by reducing the effects of interference and signal obstruction. When one or more wireless communication devices 810 miss a command to activate, one or more of the devices 810 may flash out of sequence over time. However, the wireless communication devices 810 that missed a command are able to identify how many flashing cycles were missed and synchronize flashing (both duration of time and frequency) to the other wireless communication devices 810.

In another embodiment of the invention, the flashing of the wireless communication devices 810 may be staggered. For example, a first set of wireless communication device (or a single one) may flash for a period of time and a second set (or single one) may begin flashing after the first set has started flashing and/or completed its flashing cycle. This staggered flashing may be done with a large number of different wireless communication device sets or single devices. Staggered flashing may be accomplished by a time delay that is programmed into particular wireless communication devices 810. When the particular wireless communication devices 810 receive an activation command, flashing does not start until the time delay has been completed.

The activation device 825 may record frequency shift integrity of each communication device 810. To minimize the natural phenomenon of a degrading radio link and frequency drift, the configuration device 700 may record the shift during a diagnostic mode. Frequency correction measures may be then used in a phase lock loop synthesizer or the troublesome wireless communication device 825 may be replaced before failure.

E. ACTIVATION AND SIGNALING METHODS

Figure 9:
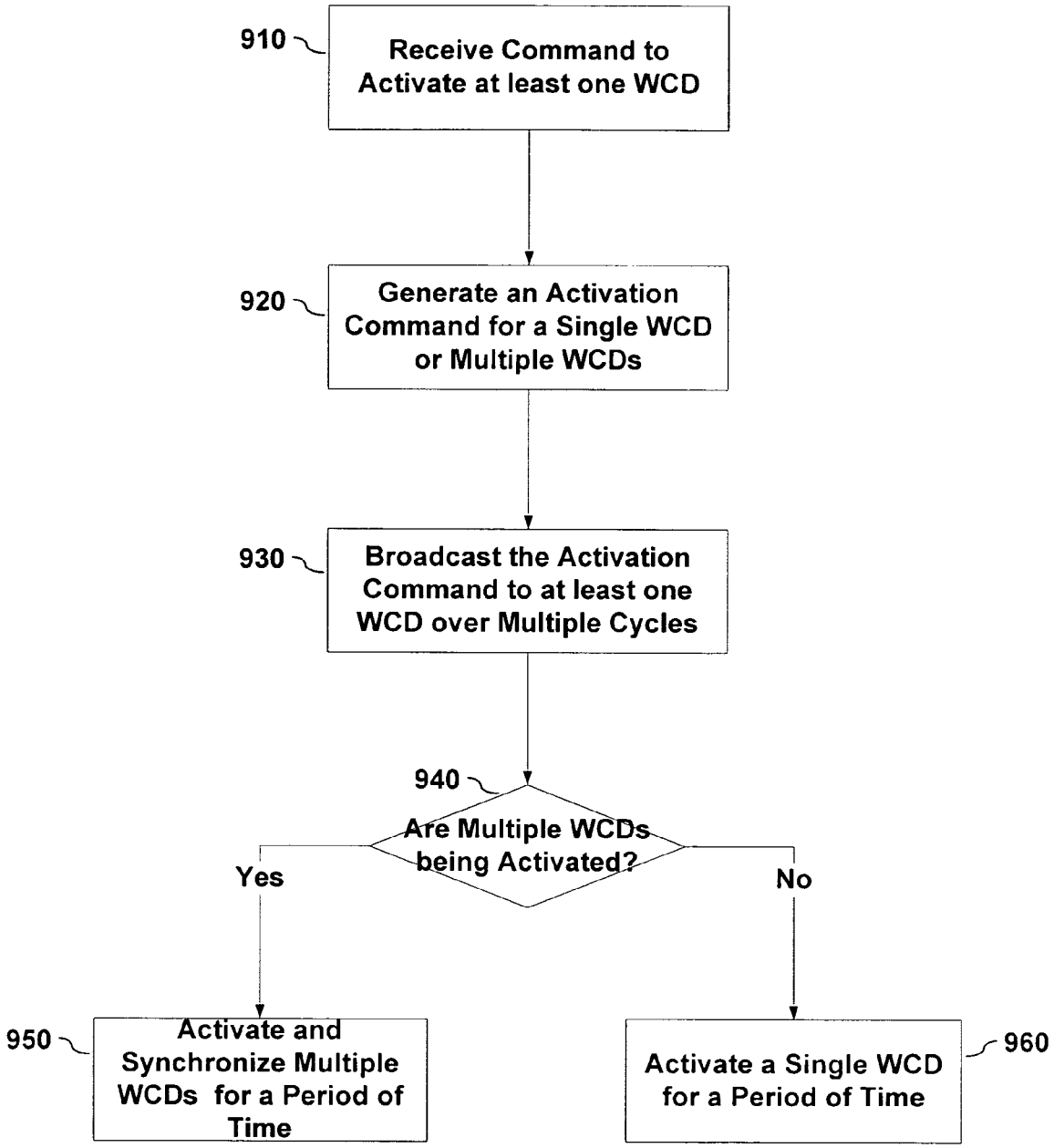
FIG. 9 is a method for activating a single, or multiple, wireless multi-purpose communication device according to one embodiment of the invention.
Figure 10:
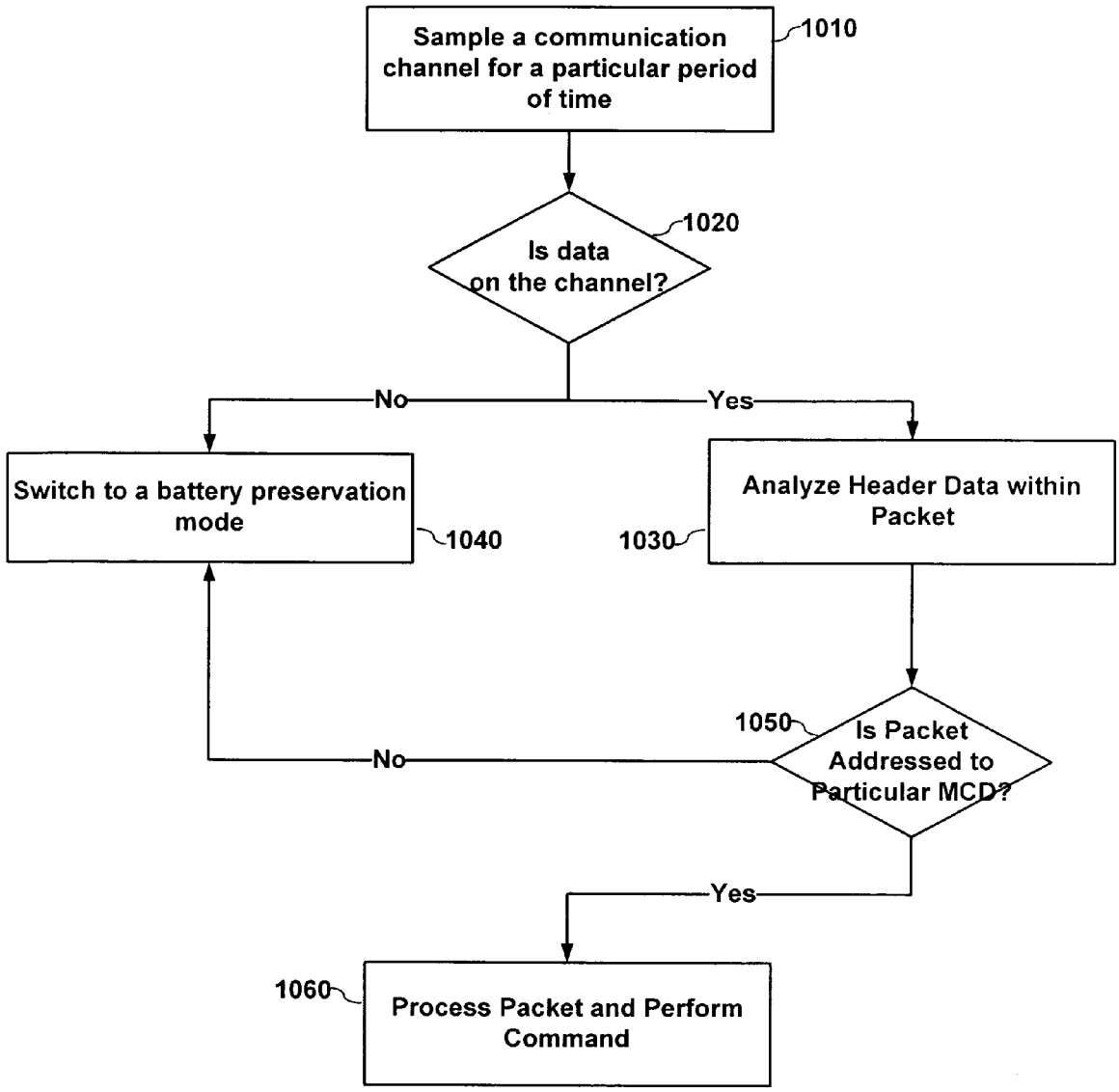
FIG. 10 is a method for detecting and responding to activation data by a wireless multi-purpose communication device according to one embodiment of the invention.

FIGS. 9 and 10 are flowcharts illustrating methods according to one or more embodiments of the present invention.

FIG. 9 is a flowchart illustrating a method for activating a wireless communication device according to one embodiment of the present invention. An activation device receives a command 910 to activate at least one wireless communication device ("WCD"). This command may be in response to an individual pushing a button, a sensor providing the command (time-of-day sensor sending command at sundown), or other source of an activation command. In response, the activation device generates an activation command 920 for a single or multiple wireless communication device. The activation device broadcasts 930 the activation command to at least one wireless communication device over multiple cycles.

If multiple wireless communication devices are being activated, then the particular wireless communication devices recognize the activation command and perform a particular function accordingly 950. For example, the particular wireless command devices may begin to flash at a particular frequency for a time duration. If a single wireless communication device is being activated, then the particular wireless communication device recognizes the activation command and performs a particular function accordingly 960.

FIG. 10 is a flowchart illustrating a method for signal processing in a wireless communication device. A wireless communication device samples a communication channel 1010 for a particular period of time. The wireless communication device is attempting to detect a command (e.g., an activation command), if present, that is addressed to it. If there is not any data on the channel, then the wireless communication device switches 1040 to a battery preservation mode, such as stand-by or sleep mode until sampling the communication channel again.

If data is on the channel, then the wireless communication device analyzes information 1030, such as a header data, within the packet to determine if the packet is addressed to the wireless communication device. If the packet is addressed to the particular wireless communication device, then the packet is processed and a function specified in the packet is performed 1060.

F. ALTERNATIVE EMBODIMENT OF THE PRESENT INVENTION

One skilled in the art will recognize that the present invention has numerous embodiments and applications. The descriptions below are exemplary of these other embodiments and applications.

1. Surface Mounted Lighting

A corner crosswalk embodiment of the present invention uses one or more surface mounted wireless communications devices to enable flashing of devices at the corner of a street potentially interoperating with a traffic controller. This would allow pedestrians, cyclists, or traffic controller to cue signal, warning motorists by signaling surface mounted wireless communication devices that pedestrians and/or cyclists wish to cross intersection A transit approach notification embodiment of the present invention uses one or more surface mounted wireless communication devices that communicate with a wireless controller located in transit vehicles, including bus, train, taxi, and shuttle. At the approach of the correct transit vehicle, an identifying image, light, and/or sound could be used to notify potential passengers of the impending transit vehicle's approach.

A transit vehicle containing on-off switch start AT allows a transit vehicle operator to turn on an activation device for advanced warning to transit stops that the impending identified vehicle is approaching within a certain measure of time that may be identified and relayed to a wireless communication device or devices. Additionally, one or more wireless communication devices, located in such a way that they are readily viewable to potential transit vehicle passengers, may engage potential transit vehicle passenger via optical or audio communication, relating essential information including the time until the approach of the transit vehicle, the route ID, and/or special bus features.

A fire hydrant proximity identification embodiment of the present invention uses one or more surface mounted wireless communications devices to identify the location of water hydrants to improve ease of location for fire and/or emergency vehicles. A driver in the relating fire and/or emergency vehicle would flip a switch on a small in-vehicle transmitter that would enable surface mounted communication devices to flash and/or signal to impending vehicle within a pre-determined distance of the approach of said vehicle(s).

A notification of speeding embodiment of the present invention uses one or more surface mounted wireless communications devices to notify motorists that their speed exceeds that of the posted limit, or notifies them that their speed exceeds that of an impending corner or road hazard. The wireless communication device may either be enabled with a sensor to detect a vehicle's speed or linked to an activation device that provides this function. When a driver approaches, based on speed constraints such as exceeding speed limit, exceeding safe speed for safe navigation of a corner or hazard, etc., the wireless communication device may signal to motorist with one or more optical signaling sequences and/or methodologies, allowing motorist to realize that they may need to modify their speed for their environment.

A dynamic road lighting embodiment of the present invention uses one or more surface mounted wireless communication devices to trigger street lights base upon one or more methodologies such as with the approach of vehicles, cyclists, and/or pedestrians, by time of day, or by environmental factor such as a public or private event. For example, at the approach of a car down a roadway, wireless communication devices would activate or trigger the activation of a series of street lights that shine as the car approaches and turn to a different power state after the car leaves.

A hazard ahead identification embodiment of the present invention uses one or more surface mounted wireless communication devices to warn impending motorists, pedestrians, or cyclists of potentially hazardous changes, including raised medians, changes in the road's surface and/or the road's direction, such as curves and corners, and intersections with one or more transit type. By using wireless signaling within each device or through communication of an advanced warning notification device, each device dynamically identifies the approach of vehicles, cyclists, and/or pedestrians and displays surface mounted communication warning to them of the potential impending hazard.

An icy road condition beacon embodiment of the present invention uses one or more surface mounted communications devices placed on a pole, such as existing snow-depth poles, road signs, or feature specific poles at the side of or above the road to warn impending motorists of freezing temperatures and subsequently hazardous road conditions An emergency turnout identification embodiment of the present invention uses one or more surface mounted wireless communication devices to identify areas in the roadway where police and/or emergency vehicles may turn-around and cross-over to opposite directions or additional roads linking freeways. Vehicles equipped with a special transmitter would flip a switch that would identify emergency turnouts along freeways, allowing them to turn around and/or cross over to the opposite side of a closed shoulder freeway.

A roadway exit identification embodiment of the present invention uses one or more surface mounted communications devices to identify exits along a roadway for police, emergency vehicles, or general traffic. For emergency use, vehicles would be equipped with a small transmitter with a switch that would be flipped to identify intersecting roadways and/or turnouts. For public or commercial use, there would be a motion detector that would communicate with said surface mounted communications device, or each surface mounted communications device would detect the proximity of an approaching vehicle prior to its subsequent flashing and communication.

A shared lane flow identification embodiment of the present invention uses surface mounted wireless communication devices along roadway to identify change of shared traffic lane(s), giving transition to direction of predominant traffic based upon commute time, road hazard, dynamic traffic volume indicator, or traffic cycle. This could be used on any joined, roadway seeking to maximize flows through high volume areas, including use on bridges, carpool or special lanes, and tunnels. Surface mounted wireless communications devices would flash green to one traffic direction and red to the other, able to change based upon a variety of factors including time of day, day of year, or override notification from a central or remote station for change in cycle due to accident, emergency, or other temporary and permanent reason.

An airport traffic flow embodiment of the present invention uses surface mounted wireless communications devices on airport runways and on airport tarmacs for vehicular flow assistance. Rather than wiring lights, surface mounted communications devices would identify transit patterns for planes and airport vehicles. With a small wireless transmitter or controller in vehicles, lighting colors and impending permissions would change, giving right-of-way and navigational guidelines.

A children/elderly/handicap present identification embodiment of the present invention uses one or more surface mounted wireless communication devices along roadway and/or sidewalk to warn motorists that children, the elderly, and/or handicapped individuals are present. These devices would be used in front of a school during opening and closing, at or near a playground and park, in front of a retirement home, etc); each would be pre-programmed by time of day and day of year or by the approach of vehicle, bicyclist, or pedestrian.

A vehicle exit/approach warning embodiment of the present invention uses one or more surface mounted wireless communication devices to warn pedestrians crossing in front of where the exit of a parking garage enters the street, that a vehicle is emerging from a parking garage. This would also include warning pedestrians, cyclists, and motorists that an emergency vehicle, such as a fire, ambulance, paramedic, or service vehicle is leaving or approaching a fire station, hospital, etc or traveling a path that would benefit by dynamic roadway lighting such as a service or emergency vehicle in a concentrated pedestrian area. There would be an auto sensor in each surface mounted communications device or a sensor that would communicate with each said device in the example of the parking garage or related application and structure, while there could be a switch with a small wireless controller in each emergency vehicle or a controller with related switch in each related building that a person would use prior to leaving or approaching the related locality.

A security identification embodiment of the present invention uses one or more surface mounted wireless communication devices for notification of a security breach or for proximity awareness at locations including military bases and private and public property. Each surface mounted wireless communications device would offer one or more methodologies (including flashing one or more colors, sending a wireless transmission to a central location, or emitting audio warning) of deterring intruders and warning proper authorities of the approach of unauthorized movements and/or personnel.

A pre-emptive trigger embodiment of the present invention uses one or more surface mounted wireless communication devices to receive communication from a traffic controller at the approach of an on-call emergency vehicle using a pre-empter to proceed through a traffic signal. Currently emergency vehicles use audio signaling which oftentimes does not identify their locality or proximity. By tying communication to surface mounted communications devices to a controller inserted into an existing traffic controller and placing said devices along roadway, sidewalks, and along the sides of buildings and/or traffic signs and roadway poles, pedestrians and motorists may see that an impending emergency vehicle approaches them, and the direction with which it comes. This would allow them to move over to the side of the roadway, possibly saving the emergency vehicle time getting through the intersection, which could possibly save lives or property.

A national emergency notification embodiment of the present invention uses one or more surface mounted wireless communication devices to inform pedestrians, motorists, and the general public about a state of emergency or issue of national importance. Similar to the Emergency Broadcast Network found on both television and radio, this would enable the government to convey a message to the mass population who are in urban centers and along the roadway. While a particular color could be used, devices could also issue a pre-recorded or real-time audio message, as well as be used to project an image, picture, or video along a wall, sign, or building.

An urban festive lighting embodiment of the present invention uses one or more surface mounted wireless communication devices to project multi-colored light emissions. This includes using one or more visual pixel mechanisms to create over 16.7 million color combinations that allow one or more wireless communication devices to be used for festive cheer, mood lighting, or to create a dynamic affect. Each can be tied to the approach of a vehicle to broadcast colors and or images into the environment.

2. Surface Mounted Audio

A crosswalk time notification embodiment of the present invention uses one or more surface mounted wireless communication devices to warn pedestrians of the amount of time left before the crosswalk signal ends. This could be used in conjunction with surface mounted wireless communications lighting or independently to provide audio notification of the time left on a crosswalk signal or for notification that it is okay to cross the roadway. Each device would be used in conjunction with a signaling transmitter, which could be placed inside each said device or used in conjunction with another device, including a push-button or bollard with wireless detector.

A crosswalk directional navigation embodiment of the present invention uses one or more surface mounted wireless communication devices to assist vision impaired pedestrians navigate across a crosswalk or intersection through audio emissions An instruction device embodiment of the present invention uses one or more surface mounted wireless communication devices to provide instructions to people at locations of public and private interest such as historical spots, museums, parks, zoos, public buildings, etc. At the approach of a person or by pushing an activation device such as a button, or by stepping on the surface mounted communications device, a pre-recorded or real-time audio message may be played.

An advertising embodiment of the present invention uses one or more surface mounted wireless communication devices to advertise to cyclists and pedestrians at afore mentioned locations of public and private interest.

A handicapped hazard notification embodiment of the present invention uses one or more surface mounted wireless communication devices to auto-sense the approach of handicapped pedestrians and warn of curb, door, wall, stairs, etc.

A national emergency notification embodiment uses one or more surface mounted wireless communication devices are used to deliver audio messages and/or real-time dialogue to pedestrians and/or general public regarding information of local, regional, or national concern 3. Surface Mounted Sensing A corridor traffic counter embodiment of the present invention uses one or more surface mounted wireless communication devices to identify traffic volumes along any given lane (place several to determine volumes along any given roadway)

A navigation identification embodiment of the present invention uses one or more surface mounted wireless communication devices to record movement and location, and/or transit pattern of tagged vehicles, people, or animals, for use in closed environments such as prisons, military bases, or corporate campuses or for open environments of public vehicles along roadways, or persons in cities or buildings.

A temperature identification embodiment of the present invention uses one or more surface mounted wireless communication devices to record and/or send temperature of geographic locality to remote location or store internally for remote uplink A motion detection embodiment of the present invention uses one or more surface mounted wireless communication devices to record and/or transmit detection of motion for use at military base, battlefield, corporate campus. When discrete notification of security breaches and/or personnel movements is needed in an open environment, said surface mounted devices can record employee ID information stored on a microprocessor tag such as a smart card or RFID.

A seismic transponder embodiment of the present invention uses one or more surface mounted wireless communication devices to sense seismic activity and store or transmit related data.

While the present invention has been described with reference to certain embodiments, those skilled in the art will recognize that various modifications may be provided. Variations upon and modifications to the embodiments are provided for by the present invention, which is limited only by the following claims.

What is claimed is:

1. A system for delineating a crosswalk across a street, the system comprising:

at least one wireless communication device, that may be secured to a surface on the street and at an edge of the crosswalk, that communicates information about the crosswalk in response to an activation stimulus;

an activation device that transmits an activation command, over a wireless communication channel, to the at least one wireless communication device; and wherein the wireless communication device comprises a rechargeable battery and photovoltaic cell.

2. The system of claim 1 wherein the wireless communication device has at least one light emitter that visually identifies an edge of the crosswalk.

3. The system of claim 2 wherein the at least one light emitter comprises a light emitting diode.

4. The system of claim 1 wherein the wireless communication device has at least one audio component that audibly communicates information about the crosswalk.

5. The system of claim 1 wherein the wireless communication device comprises at least one sensor provides data so that a threshold event may be identified and, in response, the wireless communication device is activated.

6. The system of claim 5 wherein the sensor is a light intensity sensor that senses an intensity of daylight.

7. The system of claim 5 wherein the sensor is a time-of-day sensor that includes a clock.

8. The system of claim 1 further comprising a configuration device that configures the wireless communication device and activation device.

9. A wireless communication device that can be securely mounted on a surface, comprising:

a housing having at least one surface that can be secured to a surface of a road;

an antenna that is configured to receive an activation command on a wireless communication channel;

a communication component that provides information to a surrounding environment;

a solar-powered rechargeable battery, coupled within the housing, that provides power to at least one component in the wireless communication device; and digital logic, within the housing, that processes data received on the communication channel.

10. The wireless communication device of claim 9 further comprising at least one sensor.

11. The wireless communication device of claim 10 wherein the sensor is a daylight sensor that detects an intensity of daylight.

12. The wireless communication device of claim 10 wherein the sensor is a time-of-day sensor comprising a clock.

13. The wireless communication device of claim 9 further comprising a photovoltaic cell that recharges the rechargeable battery.

14. The wireless communication device of claim 9 wherein the communication component comprises at least one light emitter.

15. The wireless communication device method of claim 14 wherein the at least one light emitter comprises a light emitting diode.

16. The wireless communication device of claim 9 wherein the communication component comprises an audio emitter.

17. The wireless communication device of claim 9 further comprising a memory unit that stores information recorded by the wireless communication device.

18. A method for activating a wireless communication device, the method comprising:

receiving a request to activate for at least one wireless communication device that is attached to a road;

generating an activation command for the at least one wireless communication device;

broadcasting the activation command for the at least one wireless communication device over a wireless channel;

activating the at least one wireless communication device; and wherein the wireless communication device comprises a rechargeable battery and photovoltaic cell.

19. The method of claim 18 wherein the at least one wireless communication device flashes lights after being activated.

20. The method of claim 19 wherein the lights on the at least one wireless communication device are synchronized.

21. The method of claim 18 wherein the at least one wireless communication device emits an audible signal after being activated.

22. A wireless communication device that can be securely mounted on a surface of a road, comprising:

wireless means for receiving an activation command on a communication channel;

means for providing information to a surrounding environment;

solar-powered means for locally providing power to at least one component in the wireless communication device from a rechargeable battery; and means for processing data received on the communication channel.

23. The wireless communication device of claim 22 further comprising means for sensing a threshold event after which the wireless communication device is activated.

24. The wireless communication device of claim 22 further comprising means for recharging the rechargeable battery.

25. The wireless communication device of claim 22 wherein the means for providing information comprises at least one light emitter.

26. The wireless communication device of claim 22 wherein the means for providing information comprises an audio emitter.

27. The wireless communication device of claim 22 further comprising means for storing information recorded by the wireless communication device.

* * * * *